US005213215A

United States Patent [19]

Prevot

[11] Patent Number: 5,213,215

[45] Date of Patent: May 25, 1993

[54] ADVANCED SHOCK-PROOF PACKING FRAGILE OBJECTS, SUCH AS BOTTLES

[75] Inventor: Bernard Prevot, Pessac, France

[73] Assignee: Societe Anonyme dite Les Isolants Modernes du Sudouest, Cestas, France

[21] Appl. No.: 852,807

[22] Filed: Mar. 17, 1992

[30] Foreign Application Priority Data

Mar. 22, 1991 [FR] France ..... 91 03746

[51] Int. Cl.[5] ..... B65D 81/02

[52] U.S. Cl. ..... 206/588; 206/446; 206/521; 206/592; 229/89; 229/91

[58] Field of Search ..... 206/521, 523, 583, 588, 206/590, 591, 592, 594, 446, 418; 229/89, 90, 91

[56] References Cited

U.S. PATENT DOCUMENTS

| | | | |
|---|---|---|---|
| 903,161 | 11/1908 | Banes | 206/446 X |
| 1,611,575 | 12/1926 | Aulbach | 229/91 X |
| 2,458,737 | 1/1949 | Salkowitz | 229/90 |
| 2,653,708 | 9/1953 | Spalding | 206/446 |
| 2,868,428 | 1/1959 | Bergstrom | 206/592 X |
| 2,923,402 | 2/1960 | Baker | 206/446 |
| 3,240,417 | 3/1966 | Andreini | 206/588 X |
| 3,384,221 | 5/1968 | Houtman | 206/523 |
| 3,572,574 | 3/1971 | Mears | 206/523 X |
| 3,712,462 | 1/1973 | Gabor et al. | 206/588 X |
| 3,986,610 | 10/1976 | Hawn | 206/521 |
| 4,190,160 | 2/1980 | Anderson et al. | 206/591 |
| 4,681,225 | 7/1987 | Schuster . | |

FOREIGN PATENT DOCUMENTS

| | | | |
|---|---|---|---|
| 0203691 | 12/1986 | European Pat. Off. . | |
| 2749701 | 5/1979 | Fed. Rep. of Germany | 206/523 |
| 2402596 | 5/1979 | France | 206/592 |
| 2567486 | 7/1984 | France . | |
| 966623 | 8/1964 | United Kingdom | 206/523 |
| 1247002 | 9/1971 | United Kingdom | 206/523 |

*Primary Examiner*—Bryon P. Gehman

*Attorney, Agent, or Firm*—Roylance, Abrams, Berdo & Goodman

[57] ABSTRACT

Advanced shock-proof packing for fragile objects, such as bottles, of the type including a corrugated or similar shaped cardboard casing able to fold so as to form a parallelepipedic box fully encompassing at least one bottle or similar object and a shimming structure encompassing the bottle and inserted between the latter and firstly the flanks of the box, and secondly axial shimming elements opposite the extremity flaps of the box, wherein the structure is constituted firstly by a first profile made of a suitable plastic material slit over its entire length and whose constant section has an annular shape with four external lobe-shaped protuberances defining four flanges disposed along the external generating lines of the profile and with two diametrically opposing the other two so as to correspond to the four internal angles of the box, said first profile being intended to envelop the bottle over its entire height, and secondly a second tubular profile, also slit over its entire length and whose internal and external diameters are determined so as to insert the second profile between the neck of the bottle and the first profile.

17 Claims, 4 Drawing Sheets

ADVANCED SHOCK-PROOF PACKING FRAGILE OBJECTS, SUCH AS BOTTLES

The present invention concerns an advanced packing intended to allow for the safe transportation and shipment of fragile objects and more specifically bottles or similar items.

The aim of the invention is to provide safe and multipurpose packaging allowing for the shipment, especially by mail, and with a special unit of fragile recipients, such as wine or liqueur bottles or other bottles filled with any type of liquid or other substances, and able to be adapted to various recipient diameters and/or dimensions.

There already exist shock-proof packings for the shipment of bottles and constituted by a cardboard casing folded in such a way as to form a parallelpipedic box and fitted internally with a flexible damping structure fully encompassing a bottle and formed of several natural elements and having different configurations.

The Applicant described in the patent application No 84 11056 a packing of the type described above and constituted by an alveolar foam layer placed against the internal face of the cardboard casing and by several expanded polystyrene shimming elements inserted between firstly the bottle and secondly the foam or cardboard casing.

This system, although effective, does neverthesless have the drawback of being relatively complex since it makes use of two types of different materials and is made up of too many configuration parts with different dimensions.

The object of the present invention is to mitigate these drawbacks by proposing a simpler and more practical shimming structure able to manufactured at less cost.

To this effect, the invention concerns an advanced shock-proof packing for fragile objects, such as bottles, of the type including a corrugated cardbaord casing or similar casing folded in such a way as to form a parallelpipedic box fully encompassing at least one bottle or similar item and a shimming structure encompassing the bottle and inserted between the latter and firstly the flanks of the box and secondly the axial shimming elements at the right of the extremity flaps of said box, wherein said structure is constituted by firstly a first suitable plastic profile slit over its entire length and whose constant section has an annular shape with four external lobe-shaped protuberances defining four flanges disposed along external generator lines of the profile and with two being diametrical to the other two so as to correspond to the four internal angles of said box, said first profile being used to encompass the bottle over its entire height, and secondly by a second tubular profile, also split over its entire length and whose internal and external diameters are determined so as to insert the second profile between the neck of the bottle and said first profile.

According to one preferred embodiment, the first and second profiles are embodied via the cutting of a given plastic block, preferably made of expanded polystyrene, and the second profile is obtained from the internal falling of the first profile cut up to a suitable length. The external contour of the second profile is thus completely adapted to the internal contour of the first profile and the production of the structure of the invention is clearly faster and cheaper.

In particular, the internal and external contours of the first profile advantageously have configurations and incisions enabling the profile to best adapt itself to the various shapes and dimensions of bottles and render it easier for the placing of these bottles.

Other characteristics and advantages of the invention shall appear more readily from a reading of the following description of one embodiment of the device of the invention, this description being given solely by way of example and with reference to the accompanying drawings on which :

Figure 1:
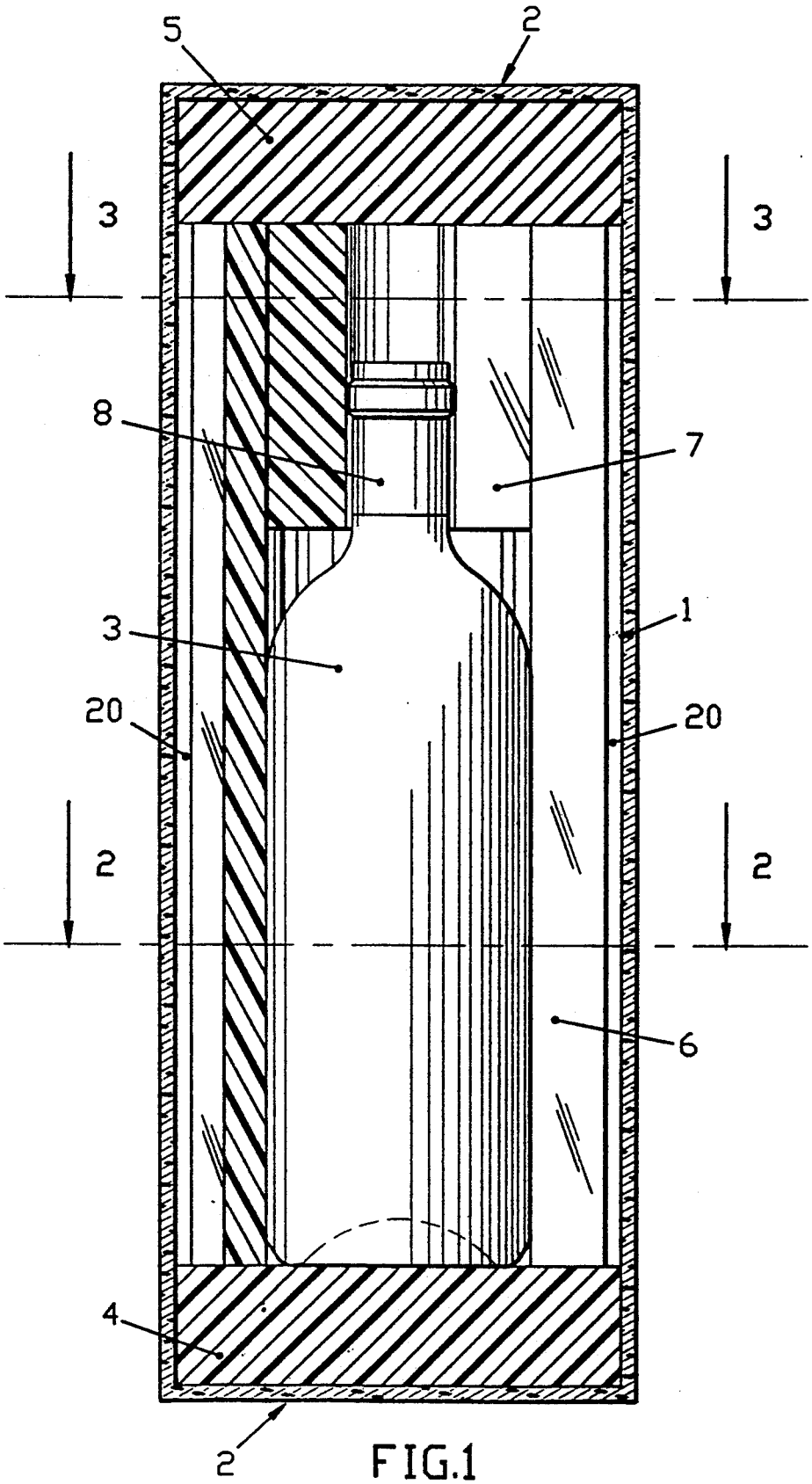
FIG. 1 is an axial diagrammatic section of a packaging conforming to the invention.
Figure 2:
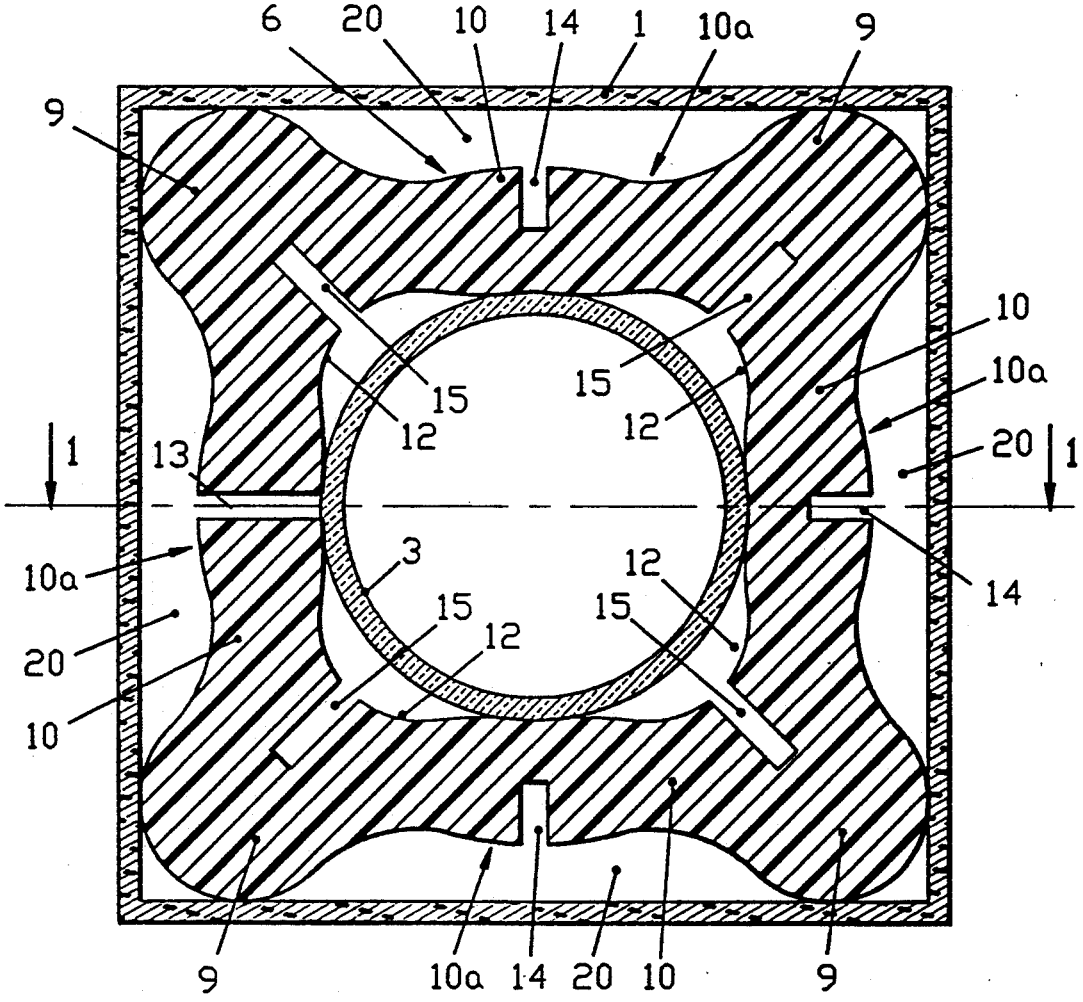
FIG. 2 is a transversal cutaway view along the line II—II of the packing of FIG. 1.

The drawings show at 1 a foldable casing made, example, of corrugated double-faced cardboard with fine ribs. This may be a conventional American box type folding parallelpipedic box with four extremity flaps symbolized at 2.

A bottle 3 is housed and adjusted inside the box with the aid of a structure conforming to the invention and completed by square extremity shims 4 and 5.

The shimming structure of the invention includes a first tubular profile 6 encompassing the bottle 3 and inserted between said bottle and the wall of the box 1 and extending from one shim 4 to the other shim 5 and one second tubular profile 7 inserted between the neck 8 of the bottle and the first profile 6.

The tubular profiles 6 and 7 have a constant section over their entire length.

The tubular profile 6 has one approximately annular section with four rounded profile projections 9, two diametrically opposing the other two, so as to externally form one profile 6 and over its entire length four flanges along the generating lines.

The section of the profile 6 is thus determined when it is inscribed in a square, each angle of said square being occupied by one projection 9.

In addition, the annular portion 10 of the profile 6 defines one external convex wall **10*a*** distanced from said square in which the profile is inscribed.

The annular portion 10 also defines one internal wall **10*b*** whose contour is more complex.

Figure 3:
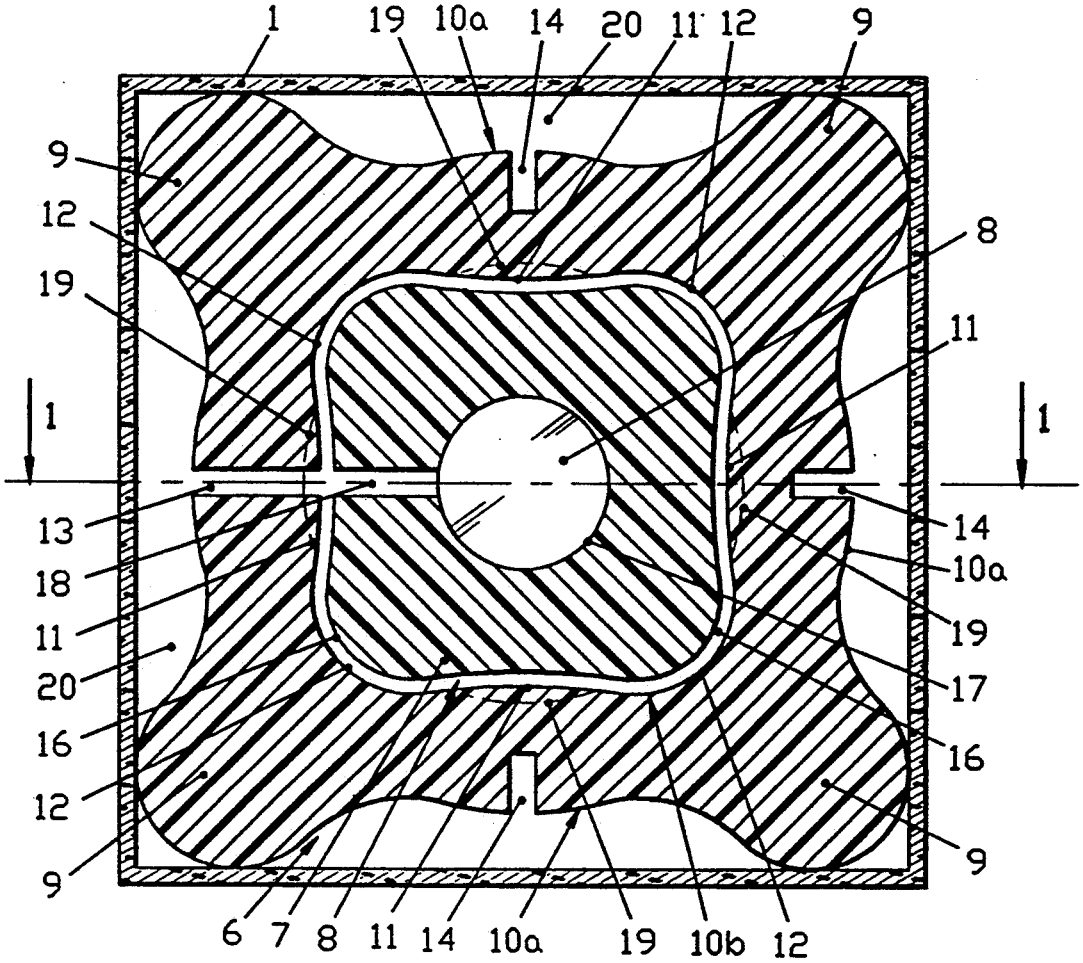
FIG. 3 is a transversal cutaway view along the line III—III of the packing of FIG. 1.

FIG. 3 clearly illustrates this internal contour (**10*b*) as the section of the profile 6 is embodied at a location where the wall 10*b* is not in contact with the bottle 3** and thus not deformed.

This contour comprises four slightly convex portions 11 with the height of the four external convex walls **10*a* and interconnected by concave connection portions 12**.

In accordance with the invention, the profile 6 has one wall slit over its entire length by a radial aperture 13 by, for example, one or two millimeters.

Moreover, opposite the aperture 13 and in the middle of the two other external convex walls **10*a*, radial apertures 14 are provided which do not traverse the thickness of the tubular wall of the profile 6 and whose width may be similar to that of the aperture 13**.

Finally, radial apertures 15, similar to the apertures 14, are provided opposite the four concave connection portions 12 and are directed towards the protections or flanges 9.

The section of the profile 7 is the simplest as, in the embodiment shown on the drawings, the external contour 16 of said profile corresponds exactly to the contour 10*b* of the profile 6, although the internal contour 17 is circular.

The profile 7 is also slit over its entire length by means of an aperture 18 similar to the aperture 13 and within the continuation of the latter.

It is extremely easy to quickly place the bottle 3 in the box 1.

The box 1 is supplied ready for use, that is shaped and internally fitted with the elements 4, 5, 6 and 7.

It merely suffices to remove one of the extremity shims, such as 4, and then engage the bottle via its neck until the latter is housed inside the profile 7. Depending on the shape of the bottle, the neck and the following sections of the bottle slightly deform the profiles 6 and 7 so as to ensure optimal shimming. Finally, the removed shim 4 is put back in place and the box is closed.

So as to facilitate insertion of the bottles, the four convex portions 11 of the internal wall of the profile 6 have one central counter-curvature zone 19 (FIG. 3), such as a concave cylindrical surface corresponding to the mean diameter of the bottles able to be housed in the packing.

Figure 4:
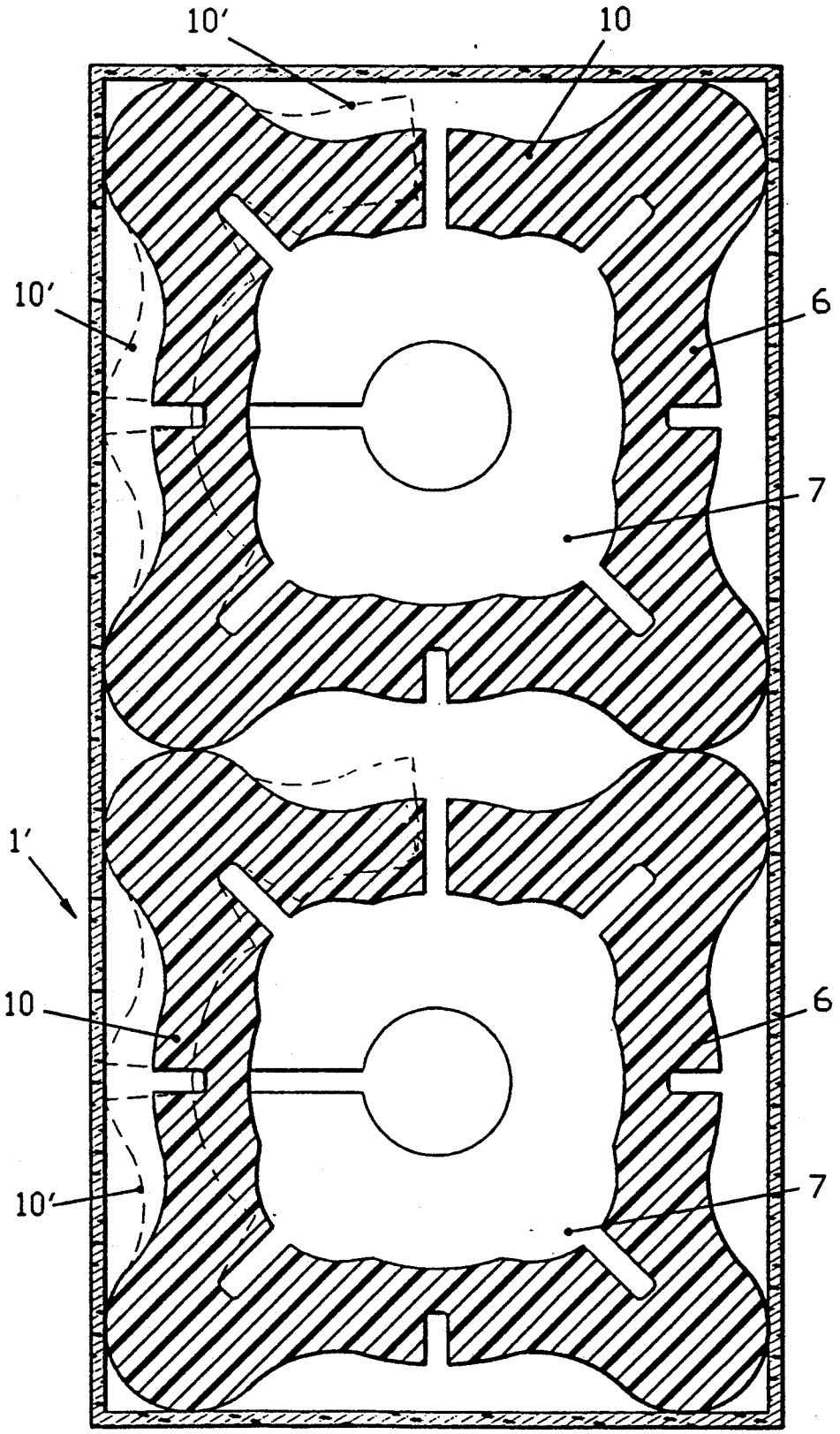
FIG. 4 is a transversal section of a double for packing conforming to the invention.

FIG. 4 shows one embodiment variant allowing for the packaging of two bottles side by side in the same packing.

To this effect, the box 1' is dimensioned so as to receive side by side two profiles 6, possibly separated by a cardboard plate (not shown) and identical, for example, to the profile 6 of FIG. 3 and inside which the two profiles 7 are engaged.

The broken lines (10') show the maximum expansion of the wall 10 of the profiles 6 for a bottle having the largest possible external diameter able to be accepted inside the box.

Of course, by means of the same principle, it is possible for the box to house three or more bottles disposed side by side.

The shims 4 and 5 and the profiles 6 and 7 are preferably made from the same material, such as expanded polystyrene, and, in accordance with the invention, via the cutting of the profiles 6 and 7 in the same parallelepipedic polystyrene block with the aid of a heating wire moved appropriately inside said block whilst remaining constantly parallel to the axis of the block.

Such a technique makes it possible to quickly and automatically embody the profiles 6 and 7 with any type of contour and have the advantage of being fully fitted together.

For example, such a heating wire is currently used for the cutting of materials, such as expanded polystyrene, and penetrates into the direction of the center of the block, thus embodying the apertures 13 and 18 and then the internal contour 17 of the future profile 7.

Then, the wire proceeds to trim the profile 7 by following a suitable travel profile giving the desired special features for the internal 12 and external 16 faces of the profiles 6 and 7 respectively, including any possible hollows 19 of the profile 6.

The external contour of the profile 6 is also obtained very easily by means of the heating wire.

The role of the apertures or slits 13, 14, 15, 18 and of the projections 9 permitting a clearance 20 between the walls 10*a* of the profile 6 and the walls of the box 1 makes it possible to house bottles of various diameters whilst allowing the profile 6, by virtue of the deformability of the material, to accept the presence of said apertures and said clearance 20 and being able to subsequently flexibly dilate so as to adapt itself to a bottle with a diameter larger than the internal diameter (at rest) of said profile.

The profile is cut to an average length making it possible to satisfactorily take into account the various types of bottles able to be accepted by the packing.

Finally, the invention is clearly not limited to the embodiment shown and described above but, on the contrary, covers all possible variants, especially as regards the nature of the material used, the shape of the external and internal contours of the profiles 6 and 7, the shapes and dimensions of the external projections 9 of the profile 6 able to ensure shimming of the structure inside the internal angles of the receiving box 1, as well as the ways and means for embodying said profiles 6 and 7.

I claim:

1. A packing for at least one fragile object, comprising:

a cardboard casing forming a parallele piped box for enclosing a fragile object and having flanks and end flaps; and shimming means, for being located between said casing and the fragile object and for encompassing the fragile object, said shimming means including axial shimming elements adjacent said end flaps, a first tubular profile of plastic material for enveloping the fragile object over an entire height thereof, said first tubular profile having a slit extending along an entire length thereof and having a substantially constant transverse cross-sectional annular shape along said length, said annular shape including four external, lobe-shaped protuberances defining four longitudinally extending external flanges on said first tubular profile arranged in diametrically opposed pairs corresponding to four internal angles of said box, and a second tubular profiles for enveloping a portion of the fragile object, located inside said first tubular profile, said second tubular profile having a slit extending along an entire length thereof.

2. A packing according to claim 1 wherein said first tubular profile comprises radial slits in internal and external faces thereof.

3. A packing according to claim 1 wherein said casing receives a plurality of first tubular profiles arranged side-by-side and separated by at least one separating plate.

4. A packing according to claim 1 wherein portions of external faces of said first tubular profile between said external flanges are spaced from said flanks of said box.

5. A packing according to claim 4 wherein said first tubular profile comprises radial slits in internal and external faces thereof.

6. A packing according to claim 4 wherein said casing receives a plurality of first tubular profiles arranged side-by-side and separated by at least one separating plate.

7. A packing according to claim 4 wherein said portions of said external faces are convex.

8. A packing according to claim 7 wherein said first tubular profile comprises radial slits in internal and external faces thereof.

9. A packing according to claim 7 wherein said casing receives a plurality of first tubular profiles arranged side-by-side and separated by at least one separating plate.

10. A packing according to claim 7 wherein said first tubular profile comprises an internal face with concave cylindrical portions.

11. A packing according to claim 10 wherein said first tubular profile comprises radial slits in internal and external faces thereof.

12. A packing according to claim 10 wherein said casing receives a plurality of first tubular profiles arranged side-by-side and separated by at least one separating plate.

13. A packing according to claim 4 wherein said first tubular profile comprises an internal face with concave cylindrical portions.

14. A packing according to claim 13 wherein said first tubular profile comprises radial slits in internal and external faces thereof.

15. A packing according to claim 1 wherein said first tubular profile comprises an internal face with concave cylindrical portions.

16. A packing according to claim 15 wherein said first tubular profile comprises radial slits in internal and external faces thereof.

17. A packing according to claim 15 wherein said casing receives a plurality of first tubular profiles arranged side-by-side and separated by at least one separating plate.

* * * * *